United States Patent [19]

Harada et al.

[11] 4,305,371

[45] Dec. 15, 1981

[54] CONTACTLESS IGNITION CIRCUIT FOR INTERNAL COMBUSTION ENGINES

[75] Inventors: Ryuzo Harada; Hiromi Watanabe, both of Yokosuka, Japan

[73] Assignee: Oppama Kogyo Kabushiki Kaisha, Tokyo, Japan

[21] Appl. No.: 133,841

[22] Filed: Mar. 25, 1980

[30] Foreign Application Priority Data

Feb. 14, 1980 [JP] Japan ..... 55-17147

[51] Int. Cl.[3] ..... F02P 7/02

[52] U.S. Cl. ..... 123/613; 123/656; 123/649; 315/209 T

[58] Field of Search ..... 123/613, 649, 651, 652, 123/656, 146.5 A; 307/253, 268; 315/209 T

[56] References Cited

U.S. PATENT DOCUMENTS

| | | | |
|---|---|---|---|
| 3,348,073 | 10/1967 | Oudard | 307/252 C |
| 3,613,654 | 10/1971 | Gilbert | 123/613 |
| 3,868,938 | 3/1975 | Trass | 315/209 T |
| 3,878,824 | 4/1975 | Haubner et al. | 315/209 T |
| 4,122,814 | 10/1978 | Ford | 123/613 |
| 4,233,951 | 11/1980 | Take | 123/651 |

*Primary Examiner*—Parshotam S. Lall

[57] ABSTRACT

This invention relates to a contactless ignition circuit for internal combustion engines characterized in that a primary short-circuiting current flowing through the primary winding of an ignition coil is made to flow through a power transistor controlled to be conducted and interrupted by a photoswitching means, the formation is small and simple, the contact is not worn and the life is long.

4 Claims, 5 Drawing Figures

CONTACTLESS IGNITION CIRCUIT FOR INTERNAL COMBUSTION ENGINES

This invention relates to a contactless ignition circuit for internal combustion engines characterized in that a primary short-circuiting current flowing through the primary winding of an ignition coil is made to flow through a power transistor controlled to be conducted and interrupted by a photoswitching means.

There is already known an ignition circuit for internal combustion engines wherein a primary short-circuiting current of the primary winding for ignition is interrupted and conducted by a mechanical contact connected in parallel with a capacitor for extinguishing arcs with the rotation of the crankshaft of the engine.

However, in such ignition circuit, there have been problems that it is difficult to set the positions of fitting a mechanical contact and an interruption and conduction controlling cam and the wear of the contact is so remarkable that the durability of the contact is low.

Further, there is naturally a limit in the structure to the recuction of the entire shape and many complicated steps are required to assemble it. On the other hand, there are provided ignition circuits wherein a voltage induced by a current source winding is accumulated in a capacitor and this accumulated electric charge is discharged to the primary winding of an ignition coil by a silicon controlled element and wherein a primary short-circuiting current induced in the primary winding of an ignition coil is made to flow through a power transistor, this power transistor is conducted and interrupted by a trigger of a silicon controlled element and the trigger of this element is controlled by a resistance branch circuit of an induction current flowing through the primary coil.

However, in the former ignition circuit, there are effects that the places of setting the silicon controlled element and trigger coil can be made small without limit, the contact is not worn and the life on the circuit is long but there are defects that the weight is increased and the current source winding is melted and cut by a surge voltage.

The latter ignition circuit is of a subswitch system using a thylistor and a transistor for small signals, the trigger level of the thylistor is so high that the response sensitivity is low and therefore there is an inconvenience that no ignition can be made at the time of a low speed.

The present invention is made in view of such conventional problems and particularly has it as an object to provide a contactless ignition circuit for internal combustion engines wherein a primary short-circuiting current flowing through the primary winding of an ignition coil is controlled to be conducted and interrupted through a power transistor, this controlling operation is made by a switching operation of a photoelectric converting element, the switching operation is made by a light shielding means of shielding and projecting light onto a light receiving element synchonously with the rotation of the engine or a light emitting means of emitting light at a proper timing synchronously with the rotation of the engine, the formation is small and simple, there is no problem of the wear of the contact and the life is long.

As mentioned above, in the present invention, as the primary short-circuiting current flowing through the primary winding of the ignition coil is controlled to be conducted and interrupted through a power transistor and this controlling operation is made by the switching operation of a photoelectric converting element and, even if the current induced in the primary winding when the rotor rotates at a low speed is slight, the above mentioned power transistor will be operated at a high sensitivity, a high voltage will be reasonably and efficiently fed to the secondary winding, a sharp spark will be generated at the spark plug and the expected igniting operation will be carried out. Further, as such conventional trigger circuit and trigger coil are not used, there are advantages that the trigger coil is not likely to be melted and cut by a surge voltage and that the formation can be simplified.

The above mentioned object, other objects, features and advantages of the present invention will become clear from the following detailed descriptions of embodiments shown in the accompanying drawings in which:

FIG. 1 is a contactless ingition circuit diagram showing an embodiment of the present invention;

FIGS. 2(*a*), (*b*) and (*c*) are wave form views of the respective parts of the circuit;

Figure 1:
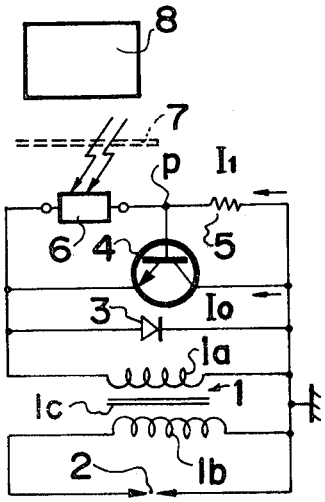

A circuit diagram showing an embodiment of the present invention is shown in FIG. 1. In the diagram, 1 is an ignition coil in which a primary winding 1*a* and secondary winding 1*b* are connected with eath other as illustrated through a core 1*c*. Both of these windings consist respectively of a small amount of a thick lead wire and a large amount of a fine lead wire would on the same core 1*c* and one terminal of each of them is connected to a common earth. A spark plug 2 is connected between both terminals of the secondary winding 1*b*. To both ends of the above mentioned primary winding 1*a*, a reverse flow preventing diode 3 is connected in parallel and the collector and emitter of a power transistor 4 are respectively connected. Further, a voltage dividing circuit (or a voltage detecting circuit) consisting of a voltage setting resistance 5 and a light receiving element 6 is connected to both ends of the primary winding 1*a*. The base of the above mentioned power transistor 4 is connected to the connecting neutral point P of them. By the way, a light shielding plate 7 fitted to a member operating to rotate or rise and fall as synchronized with the rotation of the engine is arranged in front of the above mentioned light receiving element 6. Such light emitting element as LED or a natural light projecting means 8 is arranged so as to correspond to a through hole made in the light shielding plate 7. In this case, the light emitting element is lighted by another direct current source different from the the above mentioned ignition circuit.

Figure 2:
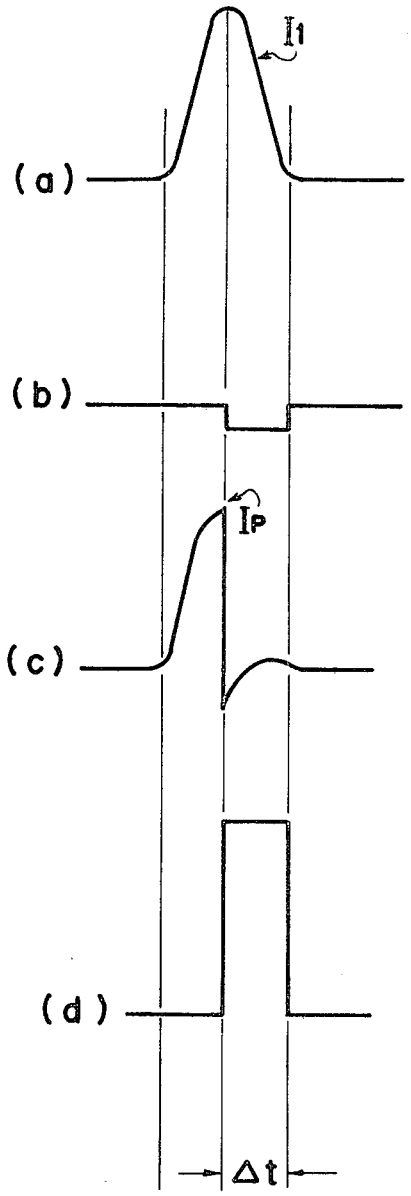
FIG. 2(*d*) is a current wave form view of a light emitting means shown in FIG. 4.

First, by the rotation of the rotor, a primary short-circuiting current I will be induced in the primary winding 1*a* of the ignition coil 1 and will be divided as in $I_o$ and $I_1$ into the above mentioned two circuits connected in parallel with each other. The wave form of the current flowing through the primary winding 1*a* is shown in FIGS. 2(*a*). In this state, the power transistor 4 is on and the light receiving element 6 is not receiving the light projected from the high resistance, that is, the light projecting means 8. Therefore, the light receiving element 6 and light projecting means 8 are shielded from each other by the light shielding plate rotating as synchronized with the rotation of the engine. In such state, the internal resistance of the light receiving element 6 against the above mentioned resistance 5 is so large that the current will flow between the base and emitter of the power transistor 4 to make the transistor 4 on, short-circuit the primary winding 1*a* and feed the primary short-circuiting current to it.

On the other hand, when the above mentioned light shielding plate 7 further rotates and the through hole made in it is opposed to the light receiving element 6, the light from the light projecting means 8 will be incident upon the light receiving element 6 and the internal resistance of the element will greatly reduce. Therefore, the current will flow through this light receiving element 6. The current between the base and emitter of the power transistor 4 will be as shown in FIG. 2(*b*). Further, the time Δt for which this current will flow is selected by freely setting the length of the through hole made in the above mentioned light shielding plate 7. for this time Δt, the above mentioned power transistor 4 will be off and, as shown in FIG. 2(*c*), the current flowing to the peak value of $I_p$ will be momentarily interrupted. Thus, by the interrupting operation of this power transistor, a high voltage will be induced in the secondary winding $I_b$ of the ignition coil 1. What is important here is that, so that the base of the above mentioned power transistor 4 may be triggered when the primary short-circuiting current reaches a substantial maximum value (Δt time point), the size of the above mentioned resistance 5 and the size of the through hole made in the light shielding plate 7 are determined to thereby effectively interrupt the above mentioned power transistor 4 and obtain a high voltage in the secondary winding. Thus, the on-off signal of the photoelectric converting element can be obtained to make a sharp rising and falling operation of the power transistor 4. The same ignition in the low speed range as by the conventional point type ignition means can be smoothly made and the internal combustion engine can be quickly and efficiently started.

Figure 3:
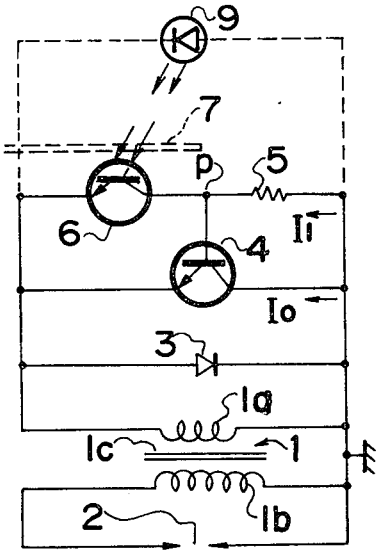
FIGS. 3 to 5 are contactless ignition circuit diagrams showing the other embodiments of the same.

FIG. 3 shows another embodiment of the contactless ignition circuit according to the present invention. It is different from FIG. 1 in respect that a light emitting diode (of infrared rays) or any other light emitting element 9 is used for the light projecting means and is connected in parallel with the above mentioned primary winding 1*a*. In such case, as different from the one in FIG. 1, no outside current source is required, the formation for taking natural light is not complicated, therefore the circuit formation can be made and, on the other hand, as the light amount varies with the fluctuation of the primary winding current, for example, such constant current circuit as keeps the light amount level constant at least while the light is being projected through the through hole of the above mentioned light shielding plate 7 is used as required. By the way, the operation in this case is also the same as in FIG. 1 and a high voltage can be effectively induced in the secondary winding by the photoswitching operation.

Figure 4:
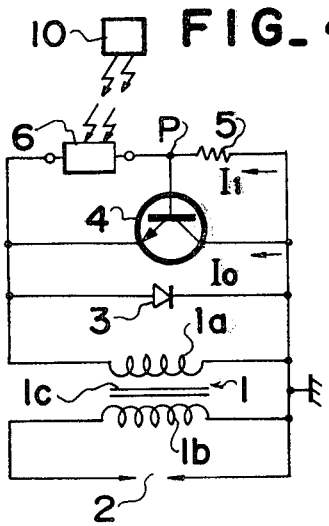

FIG. 4 shows further another embodiment of the contactless ignition circuit. Its difference from the above mentioned two embodiments is that a light projecting means 10 of such light emitting element as a light emitting diode or lamp is connected to another outside circuit than the ignition circuit without using the light shielding plate 7 and is made to flicker as synchronized with the rotation of the engine. According to this, by projecting light to the light receiving element 6 by the light projecting means 10 at a proper timing, the current between the base and emitter of the power transistor 4 can be controlled as shown in FIG. 2(*b*) so as to make this power transistor off and induce an expected high voltage in the secondary winding 1*b*. By the way, in order to efficiently obtain such high voltage, the light amount level of the light emitting means 10 is controlled as shown in FIG. 1(*d*) for the time Δt so as to momentarily feed and interrupt the light amount of the above mentioned light projecting means 10.

Figure 5:
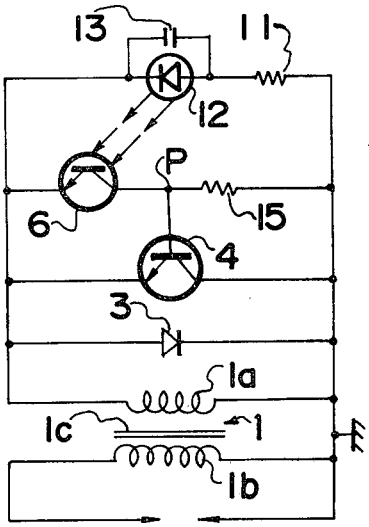

FIG. 5 is of further another embodiment of the contactless ignition circuit. Here, a series circuit consisting of a resistance 11 and such light emitting element 12 as a light emitting diode is connected in parallel with the above mentioned primary winding 1*a* and a charging and discharging capacitor 13 is connected in parallel with such light emitting element 12 as a light emitting diode. According to this, the timing of the light projection by such light emitting element 12 as the above mentioned light emitting diode is irrespective of the rotation of the engine, the level of the current induced in the primary winding 1*a* is always watched and the timing of the light projection is set by the charging and discharging characteristics of the time constant circuit consisting of the resistance 11 and capacitor 13. That is to say, this light projection is timed by detecting the magnitude of the primary current. When the voltage of the capacitor 13 reaches a predetermined level of the peak, a large current will be made to flow through the light emitting element 12 for the time Δt to make it effectively emit and project light onto the light receiving element 6. Therefore, various characteristics of the resistance 11, capacitor 13 and such light emitting element 12 as the light emitting diode must be selected in advance so as to form a discharge circuit when the primary current reaches the peak.

What I claim is:

1. A contactless ignition circuit for internal combustion engines characterized in that the collector and emitter of a power transistor are connected respectively to both ends of the primary winding of an ignition coil and the base of this power transistor is connected to the neutral point of the connection of a resistance and light receiving element connected in series to both ends of said primary winding so that, when the current flowing through said primary winding reaches a substantial peak value, a light projecting means will project the light of a maximum level onto said light receiving element.

2. A contactless ignition circuit for internal combustion engines according to claim 1 characterized in that the light of the maximum level is projected onto the light receiving element by said light projecting means through such light emitting means as a light emitting diode flickering as synchronized with the rotation of the engine.

3. A contactless ignition circuit for internal combustion engines according to claim 1 characterized in that the light of the maximum level is projected onto the light receiving element by said light projecting means through a through hole in a light shielding plate interposed between said light projecting means and light receiving element and rotating or moving as synchronized with the rotation of the engine.

4. A contactless ignition circuit for internal combustion engines according to claim 1 characterized in that the light of the maximum level is projected onto the light receiving element by said light projecting means at a timing based on the charging and discharging characteristics of a time constant circuit connected to said light projecting means.

* * * * *